US006220189B1

(12) United States Patent
Swithenbank

(10) Patent No.: US 6,220,189 B1
(45) Date of Patent: Apr. 24, 2001

(54) ROTATABLE FLUIDIZED BED INCINERATOR

(75) Inventor: Joshua Swithenbank, Sheffield (GB)

(73) Assignee: The University of Sheffield, Sheffield (GB)

( * ) Notice: Subject to any disclaimer, the term of this patent is extended or adjusted under 35 U.S.C. 154(b) by 0 days.

(21) Appl. No.: 09/269,438

(22) PCT Filed: Sep. 29, 1997

(86) PCT No.: PCT/GB97/02684

§ 371 Date: Jun. 14, 1999

§ 102(e) Date: Jun. 14, 1999

(87) PCT Pub. No.: WO98/13648

PCT Pub. Date: Apr. 2, 1998

(30) Foreign Application Priority Data

Sep. 27, 1996 (DE) ..... 9620154

(51) Int. Cl.[7] ..... F23G 5/00; F23G 7/00; F23G 5/04; F23D 1/00

(52) U.S. Cl. ..... 110/245; 110/243; 110/244; 110/219; 110/258; 110/264

(58) Field of Search ..... 110/243, 244, 110/245, 224, 226, 219, 227, 259, 264, 265

(56) References Cited

U.S. PATENT DOCUMENTS

| | | | | |
|---|---|---|---|---|
| 4,039,272 | * | 8/1977 | Elliot | 431/7 |
| 4,060,042 | * | 11/1977 | Baraldi et al. | 110/14 |
| 4,066,024 | | 1/1978 | O'Connor | 110/8 |
| 4,108,088 | * | 8/1978 | Burden | 110/246 |
| 4,161,103 | | 7/1979 | Horgan et al. | 60/39.35 |
| 4,177,636 | | 12/1979 | Horgan | 60/39.35 |
| 4,683,541 | * | 7/1987 | David | 364/500 |
| 4,970,970 | * | 11/1990 | Avery | 110/246 |
| 5,070,821 | | 12/1991 | Virr | 122/7 K |

FOREIGN PATENT DOCUMENTS

| | | | |
|---|---|---|---|
| 1 471 598 | | 4/1977 | (GB) . |
| 2 008 732 | | 6/1979 | (GB) . |
| 1 581 672 | * | 12/1980 | (GB) . |
| WO 82/00875 | | 3/1982 | (WO) . |

* cited by examiner

*Primary Examiner*—Denise L. Ferensic
*Assistant Examiner*—K. B. Rinehart
(74) *Attorney, Agent, or Firm*—Fish and Richardson P.C.

(57) ABSTRACT

A rotatable fluidised bed incinerator comprises a rotatable combustion chamber, a means for rotating the combustion chamber, a means for introducing combustible material into the combustion chamber, and a means for introducing a gas into the combustion chamber to create a fluidised bed within the chamber. A flow area of the combustion chamber remains substantially constant or increases with decreasing chamber radius.

20 Claims, 8 Drawing Sheets

FIG. 3
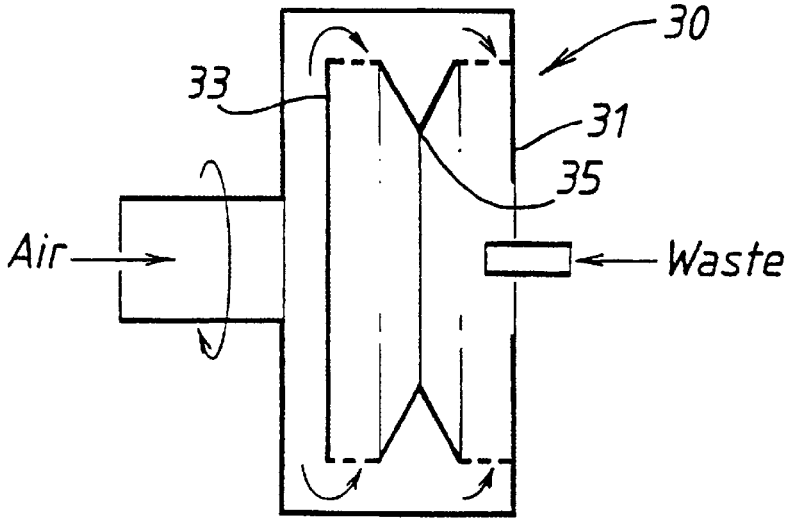
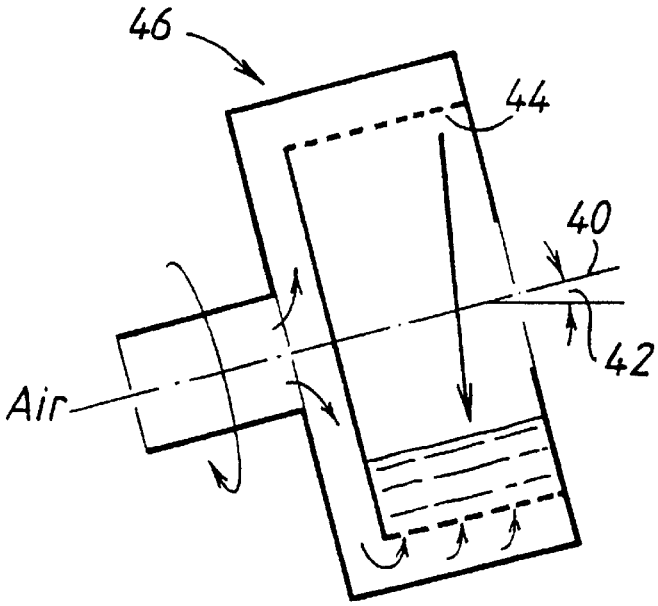
FIG. 4A
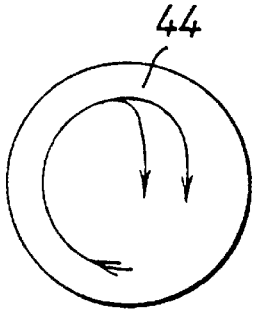
FIG. 4B

FIG. 5
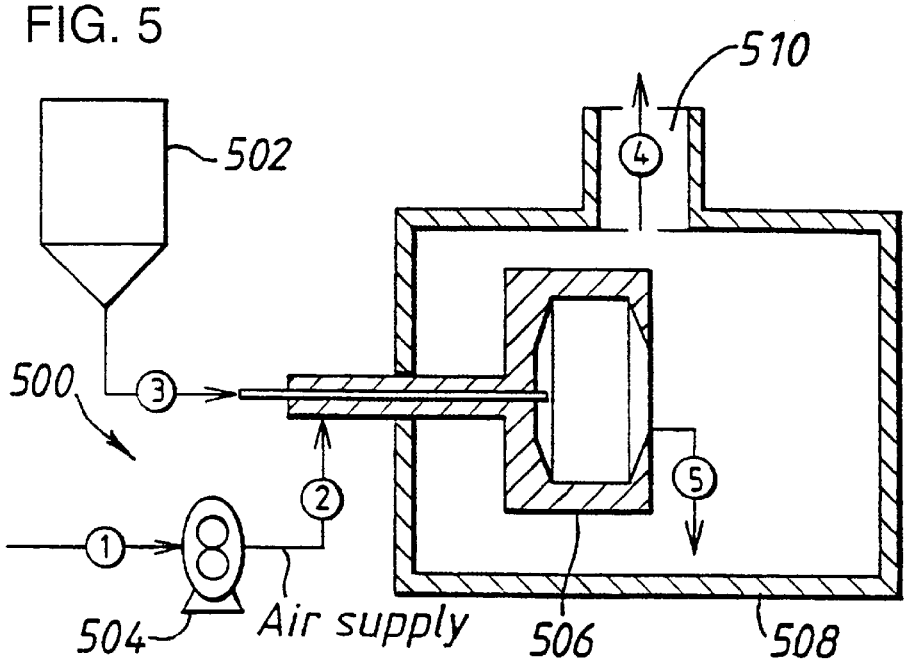
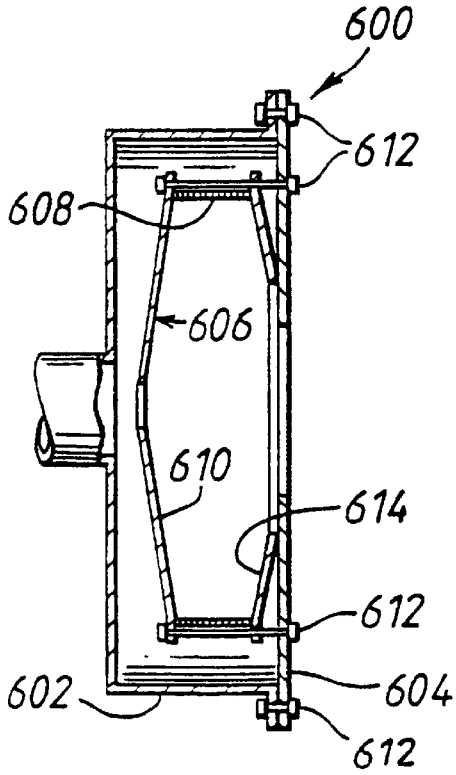
FIG. 6
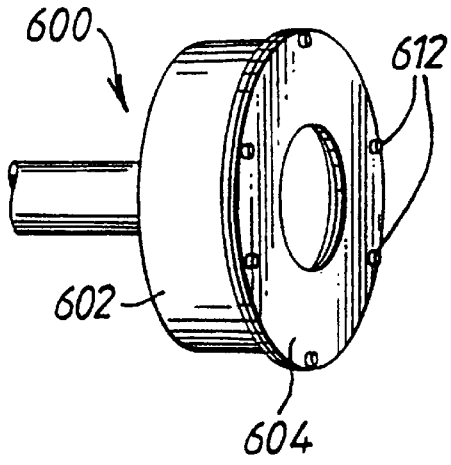
FIG. 7

ROTATABLE FLUIDIZED BED INCINERATOR

This is a continuation of International Patent Application No. PCT/GB97/02684, with an international filing date of Sep. 29, 1997, now pending.

BACKGROUND

This invention relates to a rotatable fluidised bed incinerator for incineration of combustible material.

Towns and cities are faced with an increasingly difficult problem in dealing with the disposal of wastes such as sewage. Traditionally, sewage sludge has been disposed of by open dumping, landfill or dumping in the sea. These practices either require large land acreage and are therefore becoming less attractive as the areas available for disposal near metropolitan areas rapidly disappear, or, in the case of sea dumping, are now or are shortly to be prohibited by new legislation.

Incineration of sewage sludge is recognised as an alternative possibility. Lurgi fluidised bed incinerators are widely used at present to burn sewage sludge. In this process the sludge must be de-watered to about 30% solids before combustion can be maintained. At this concentration of water, the sludge has the consistency of a thick paste and combustion takes place with no significant release of heat. If a filter press is used for de-watering to 35% solids, then the sludge has the consistency of cardboard and a significant heat output can be achieved. Lurgi fluidised bed incinerators are used to burn sewage sludge at a typical consumption rate of about 0.02 kg(dry)/s/$m^2$ and, accordingly over 300 Lurgi style incinerators of 3 meters bed diameter would be required to cope with the expected future UK disposal requirements of about 5 million tonnes for the year.

Another possible approach is to dry the sludge to a dry powder and feed it into pf coal fired power station boilers. To feed paste sludge at, say, 30% solids into power station boilers would, however, require massive transport of an undesirable material which is difficult to handle.

A further problem with rotatable fluidised bed incinerators is the elutriation of matter either before or after combustion. This results in either the undesirable distribution of ash or less effective or incomplete combustion of waste material. Furthermore, the bed depth is typically relatively shallow which imposes limits upon the volume of material which can be processed by a fluidised bed incinerator at any given instant in time.

SUMMARY

It is an object of the present invention to at least mitigate some of the problems of prior art fluidised bed incinerators.

Accordingly, the present invention provides a rotatable fluidised bed incinerator comprising a rotatable combustion chamber, means for rotating the combustion chamber, means for introducing combustible material into the chamber, means for introducing a gas into the chamber to create a fluidised bed within the chamber, wherein the rotatable combustible chamber is arranged to maintain a substantially constant gas velocity across the fluidised bed or with decreasing radius of the chamber.

There is further provided a rotatable fluidised bed incinerator comprising a rotatable combustion chamber, means for rotating the combustion chamber, means for introducing combustible material into the chamber, means for introducing a gas into the chamber to create a fluidised bed within the chamber, wherein the cross-sectional area of the chamber increases with decreasing chamber radius.

Advantageously, as the velocity of the gas is radially substantially constant, elutriation of either ash or combustible material is substantially reduced. Furthermore, the depth of the fluidised bed can be substantially increased as compared to prior art fluidised beds.

Preferably, the bed of the fluidised bed incinerator is caused to rotate rapidly about its longitudinal axis. In this way, the effective weight of the bed can be increased dramatically. Fluidisation occurs when the pressure drop across the bed is equal to the weight of the bed, in the case of a bed of near monosized particles, that is particles having substantially the same cross-section. Normally, the weight of the bed is determined by gravity. However, with the bed under rotation, the air flow passing through the bed can be increased proportionally to the "G" level produced by the rotation and the process is therefore intensified. In tests, a rotating fluidised bed has been operated at accelerations of up to 200 G.

In the case of sewage sludge incineration, the rotating bed may be operated at a relatively low "G" level, for instance, from about 5 G to about 20 G, for example about 10 G, giving a much more modest pressure drop. The relatively small amount of heat released, can be removed by the flue gases.

A typical rotating fluidised bed sewage sludge incinerator according to the invention suitable for burning all the sludge from a medium size town of about 100,000 people is estimated to be only about 500 mm long×600 mm diameter. The incinerator of the invention preferably has a short aspect ratio and is desirably provided with a cylindrical chamber having walls which taper in a radial direction in order to influence or reduce the radial gas velocity required for the fluidised bed.

Preferably the rotating fluidising bed is operated together with a de-watering unit, more preferably of the centrifugal type. As a result, there can be achieved further process integration and intensification for example by combining the rotatable fluidised bed with the de-watering unit drive.

In the process of the invention, the sewage sludge is preferably de-watered to a solids concentration of from 20 to 50% , more preferably 28 to 35% by weight.

The fluidised bed preferably comprises particles of an average diameter of from 0.1 to 3 mm, and, for example, sand particles of about 1 mm diameter have been found to be very suitable.

The combustible gas is preferably air, which can, if desired, be oxygen enriched or mixed with a liquid or gaseous fuel, such as, for example, propane. The combustible gas may be at ambient temperature, or pre-heated as desired, for example, to a temperature of 200 to 400° C.

The rotatable fluidised bed is also operable at a speed such that tumbling of the upper layer of bed material takes place, and, for example, speeds producing accelerations of from 0.5 to 2 radial g at the bed, have been found to be very suitable. The tumbling action of the particles from the top of the chamber allows waste to be introduced which is immediately engulfed by red hot particles. Light materials such as paper are immediately consumed before they are elutriated (as happens in a conventional municipal or fluidised bed incinerator). The intense longitudinal and circumferential mixing which can be achieved in the apparatus according to the present invention solves one of the major problems of known fluidised bed apparatus in which the transverse mixing is limited to a distance comparable to the bed depth.

The rotatable fluidised bed provides an intensively turbulent intimate mixture of sewage sludge particles and air. Very high combustion efficiency can be achieved and this is important in improving the quality of the ash and reducing the amount of pollutants emitted.

The turbulent mixing characteristics common to all fluidised bed combustors are further enhanced in the rotating fluidised bed design of the present invention because the density of the recirculating bed material is optimised in various zones in the furnace using the extra degrees of freedom resulting from this design. For example, varying the rotation speed can be used to vary the turndown ratio of the device, as indicated above. This parameter is relatively difficult to vary in a conventional static fluidised bed.

A considerable amount of heat is absorbed and retained by the large mass of particles making up the fluidised bed, thereby creating a large thermal "fly wheel". The large thermal mass and the extreme turbulence can greatly reduce the potential for cold and hot spots to occur within the incinerator, in turn reducing the potential for stratified pockets of poor combustion to occur. In the case of the tumbling bed operation, the high turbulence can lead to a very high axial mixing.

In other, preferred, aspects of the invention, absorbent materials, such as limestone or dolomite, can be used to capture sulphur in situ, thereby efficiently reducing the emissions of sulphur dioxide and sulphur trioxide. Hydrogen chloride and hydrogen fluoride can be absorbed by adding limestone. Low carbon monoxide levels can be achieved due to the uniform temperature and good mixing of sewage sludge particles and oxygen.

DESCRIPTION OF THE DRAWINGS

Embodiments of the incinerator of the invention will now be described, by way of example only, with reference to the accompanying drawings in which:

FIG. 3 illustrates schematically a third embodiment of a rotatable fluidised bed incinerator;

FIGS. 4A and 4B illustrate schematically the operation of a rotatable fluidised bed incinerator at an angle to the horizontal;

FIG. 5 shows an arrangement for combustion of material using a rotatable fluidised bed incinerator;

FIG. 6 illustrates a cross-sectional view of an embodiment of a rotatable fluidised bed incinerator;

FIG. 7 illustrates a perspective view of the rotatable fluidised bed incinerator;

DETAILED DESCRIPTION

Figure 1:
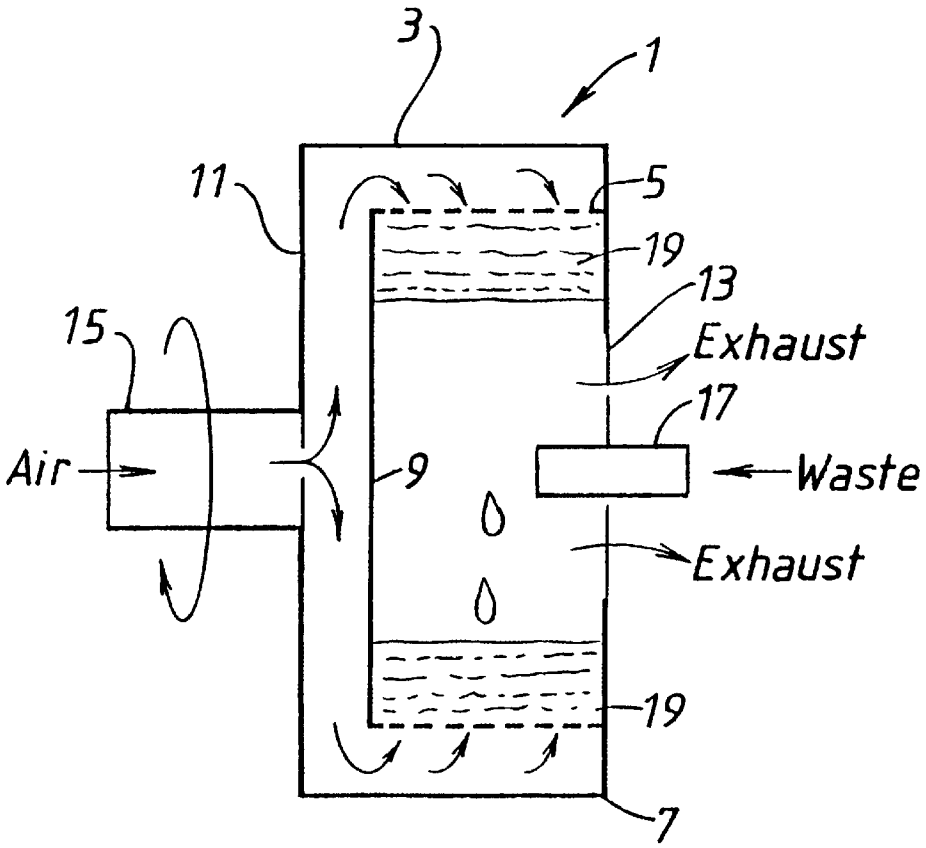
FIG. 1 shows schematically a first embodiment of rotatable fluidised bed incinerator.

In the first embodiment shown in FIG. 1 a rotating fluidised bed incinerator 1 includes a cylindrical chamber 3 which is mounted for rotation about its longitudinal axis. Within chamber 3 there is located a cylindrical air distributor 5 in the form of a perforated plate which extends from the front (right hand side in the drawing) wall 7 of chamber 3 and terminates in a substantially flat solid rear wall 9 located some distance forwardly of the rear wall 11 of chamber 3.

Front wall 7 of chamber 3 includes a large central opening 13 and, extending rearwardly from rear wall 11, is a central feed pipe 15. A waste feed pipe 17 extends along the longitudinal axis of chamber 3 from a position centrally within distributor 5 through central opening 13 to a position outside chamber 3.

In use, located within distributor 5 is a fluidised bed 19 which, when the incinerator is rotating, distributes itself substantially uniformly around the circumference of the distributor 5. Pre-heated air may be fed to the bed via inlet 15 and the air distributor 5. Alternatively, the air may be fed at ambient temperature and mixed with propane to provide at least initial ignition. Sewage sludge to be burned is fed to the bed by means of feed pipe 17. Exhaust gases exit from the incinerator via central aperture 13 and may be passed to a cyclone (not shown) for ash removal.

The above described incinerator 1 may have a diameter of about 1 meter or less. The fluidised bed 19 may comprise particles of sand having a diameter of, for example, about 1 mm.

Figure 2:
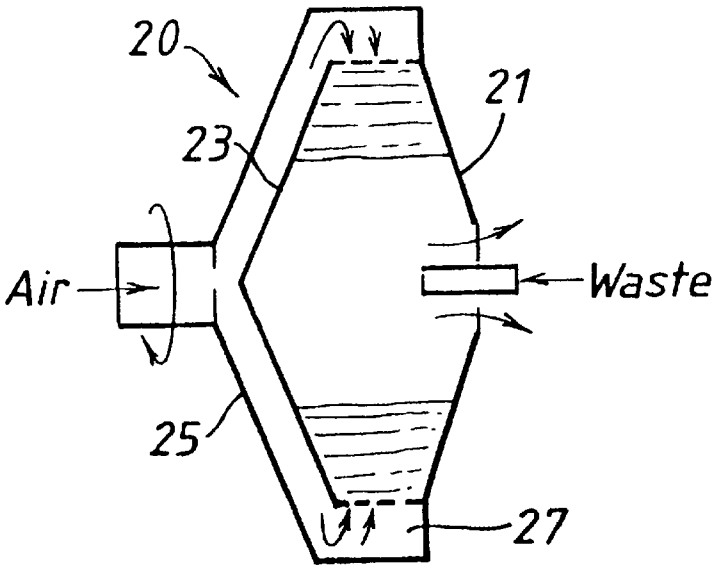
FIG. 2 shows schematically a second embodiment of a rotatable fluidised bed incinerator.

Referring to FIG. 2, there is shown a second embodiment of a rotating fluidised bed incinerator 20. The front 21 and rear 23 walls (Weir plates) are tapered towards each other in a radially outward direction. The rear wall 25 of the air distributor 27 is also tapered so that it extends substantially parallel to rear wall 23 of the incinerator.

The particulates or sewage will fluidise when the radially inward force thereon resulting from the drag created by the gas flow is sufficient to provide the radially inward acceleration required to establish and maintain circular motion.

It will be appreciated that the required radially inward acceleration will vary according to the radius of rotation of that particulate or sewage. Therefore, in some embodiments it is necessary to reduce the gas velocity with decreasing radius across the depth of the fluidised bed of particulates. This has the effect of reducing the drag and hence the radially inward force on the sewage, as is desired at smaller radii of rotation.

The effect of the tapered walls is to vary the gas velocity within the incinerator in a radial direction such that the gas velocity progressively decreases in a radially inward direction.

Preferably, the flow area of the combustion chamber progressively decreases with decreasing radius. The flow area is the area through which the gas flows and in the case of a cylindrical combustion chamber the flow area is the curved surface of a cylinder of any given radius.

With reference to FIG. 3, there is shown a further embodiment of an incinerator 30 having a progressively increasing cross-sectional area of the incinerator chamber with decreasing radius. The outer wall 31 of the incinerator is substantially parallel to the inner side wall 33 of the incinerator. The progressively varying area or cross-section of the chamber is realised using an structure 35, for example, an annulus, which has a progressively decreasing cross-section with decreasing radius. It can be seen that as the cross-section of the structure 35 decreases, the cross-sectional area of the chamber of the incinerator 30 increases. Therefore, in use, the velocity of gas decreases or remains substantially constant with decreasing radius as required.

It will be appreciated that if the speed of rotation of the incinerator is insufficient to overcome the effect of gravity, or the combined effect of gravity and the gas flow upon the mass of the particulate or sewage, at the apex of the path of the particulate, then the latter will fall towards the nadir of the path. This tumbling action improves the mixing of the particulate or sewage or other materials.

Referring to FIGS. 4*a* and 4*b*, there is shown a still further embodiment in which the axis 40 of rotation is inclined at angle 42 to the horizontal. The inclined operation of the incinerator 46 further improves the mixing of the sewage or particulates. Again, the particulate at the apex 44 of the path thereof is arranged to fall under the influence of gravity thereby improving the mixing of the particulate or sewage.

It will be appreciated that the embodiments of both FIGS. 2 and 3 can also be operated with the longitudinal axis inclined relative to the horizontal.

The angle of inclination is selectable according to the degree of mixing required. An angle 42 of 30° has been found to produce a reasonable degree of mixing.

Referring to FIG. 5, there is shown an arrangement 500 for combustion of material using a rotatable fluidised bed. During the first phase of operation, the start-up phase, the operating conditions of the rotatable fluidised bed are described below and are summarised in Table 1. A fuel feed hopper 502 stores material to be combusted. The material includes waste, sand and coal. Air is supplied to a compressor 504 at a mass flow rate of 8.856 kg/min and a volume flow rate of 7.38 $m^3$/min. The temperature of the air is 20° C. The air is at atmospheric pressure. The compressor 504 increases the pressure to 20 kPa. The air at 20 kPa is fed to the rotatable fluidised bed incinerator 506. The rotatable fluidised bed incinerator 506 is housed within a chamber 508. Initially, sand is fed into the chamber 505 of rotatable fluidised bed incinerator 506 at mass and volume flow rates of 2.13 kg/min and 1.521 $m^3$/min, at a temperature of 20° C. and at a pressure of 20 kPa. The exhaust fumes are drawn away from the chamber 508 via a flue 510 at the same mass and volume flow rates and temperature levels as it was introduced. During initialisation, ash is not produced. The speed of rotation of the incinerator 506 is sufficient to produce an acceleration of 1 G.

After initialisation as set out above, the incinerator is heated and the operating parameters change. The mass flow rate and volume flow rate are increased to 9.36 kg/min and 7.8 $m^3$/min. The pressure of the air produced by the compressor is increased to 14 kPa. The speed of rotation of the fluidised bed incinerator is increased to produce an acceleration of 4.5 G. The supply of sand from the fuel hopper 502 is terminated and coal is supplied in order to increase the operating temperature of the incinerator 506. The mass flow rate of the coal is 0.6 kg/min. The coal is introduced at atmospheric pressure. Air is extracted from the chamber 508 at a mass flow rate and volume flow rate of 9.96 kg/min and 19.92 $m^3$/min respectively. A negative pressure is induced within the chamber 508 at the above extraction mass and volume flow rates. During this phase of operation ash is still not produced. Table 2 below summarises the operating conditions during this phase of the operation of the rotating fluidised bed incinerator. The temperature of the air within the chamber is approximately 450° C.

The final phase of operation is that phase in which combustible waste material is introduced into the chamber of the incinerator 506. The mass flow rate and volume flow rate of the air supplied to the compressor 504 are reduced to 8.64 kg/min and 7.2 $m^3$/min respectively. The pressure of the air supplied by the compressor 504 is increased to 25 kPa and the rotation of the fluidised bed incinerator is increased to produce an acceleration of 8 G. The mass flow rate of the coal is reduced to 0.3 kg/min. The exhaust fumes are extracted from the chamber 508 at a mass flow rate of 10.54 kg/min and a volume flow rate of 31.93 $m^3$/min. The operating temperature is 850° C. Ash is produced and collected at a rate of 0.53 kg/min. Table 3 below summarises the operating conditions of the arrangement 500 during the combustion phase of operation in which combustible waste material is burnt.

Table 4 illustrates the design parameters of a rotatable fluidised bed incinerator according to an embodiment.

Referring to FIG. 6 there is shown an embodiment of a rotatable fluidised bed 600 comprising a cylindrical bowl 602 and an annular Weir plate 604. Housed within the bowl 602 is a cylindrical arrangement 606 which forms the combustion chamber of the incinerator. The combustion chamber 606 has a cross-sectional area which progressively varies with radius. The cross-sectional area preferably increases with radius. The combustion chamber 606 comprises a short aspect ratio air distributor 608 having a plurality of holes therein, a tapered front plate 610 and a tapered end plate 614. The rotatable fluidised bed incinerator is constructed and held together using a plurality of bolts 612.

FIG. 7 illustrates a perspective view of the rotatable fluidised bed incinerator 600 showing the cylindrical bowl 602 and the Weir plate 604 held together using bolts 612.

Figure 8:
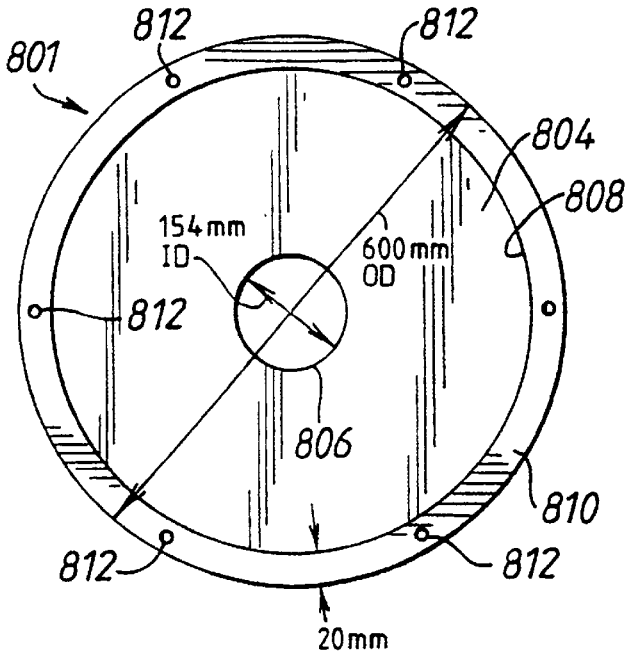
FIG. 8 illustrates cross-sectional and plan views of the bowl of the rotatable fluidised bed incinerator shown in FIG. 6.
Figure 8A:
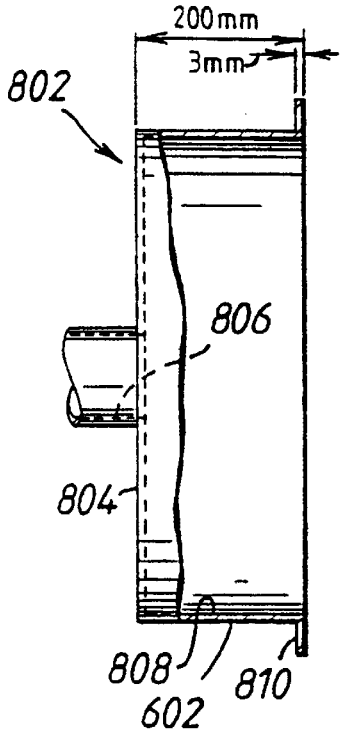

Referring to FIG. 8, there is shown cross-sectional 802 and plan 801 views of the bowl 602. Preferably, the bowl is manufactured from 3 mm thick 37-18 Nickel Chromium. The bowl has a base 804 of diameter 560 mm with a centrally disposed inlet 806 having a diameter of 154 mm for the connection of an inlet pipe (not shown) thereto. Preferably, the inlet pipe is a six inch Schedule 40 pipe. The bowl 602 comprises a cylindrical side wall 808 of diameter 560 mm and depth 200 mm. A 20 mm flange 810 is formed on the side wall 808. The flange 810 comprises six bolt holes 812 centred on 580 mm for receiving bolts. The volume of the bowl is 0.00185 $m^3$. The mass of the bowl is 14.4 kg.

Figure 9:
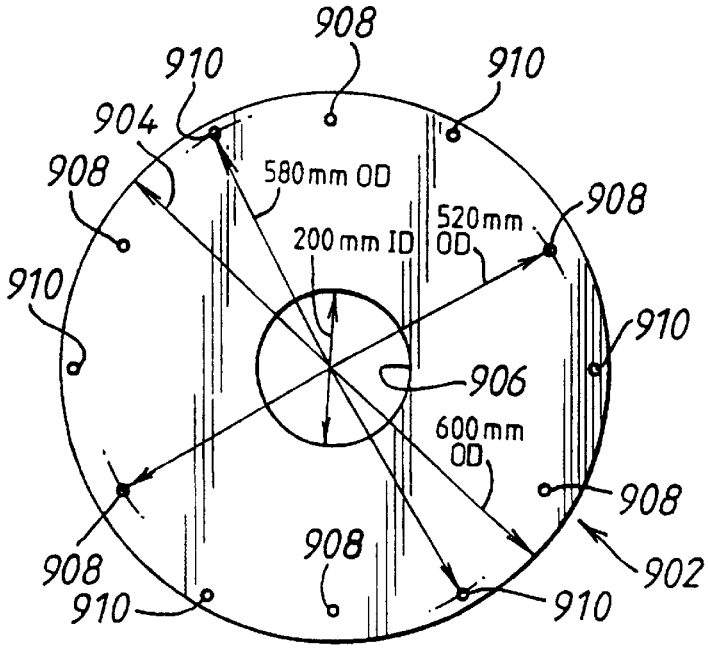
FIG. 9 illustrates a first embodiment of an annular Weir plate.
Figure 9A:
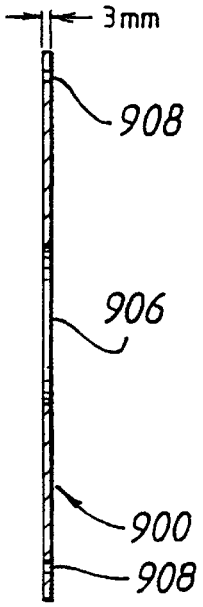

With reference to FIG. 9 there is depicted a 3 mm thick 37-18 Nickel Chromium Weir plate 604 in cross-sectional 900 and plan 902 views. The Weir plate 604 has an outer diameter 904 of 600 mm, a centrally disposed aperture 906 having a diameter of 200 mm. The Weir plate bears six bolt holes 908 centred on 520 mm centres and six bolt holes 910 centred on 580 mm centres. The Weir plate has a volume of 0.00754 $m^3$ and a mass of 5.9 kg.

Figure 10:
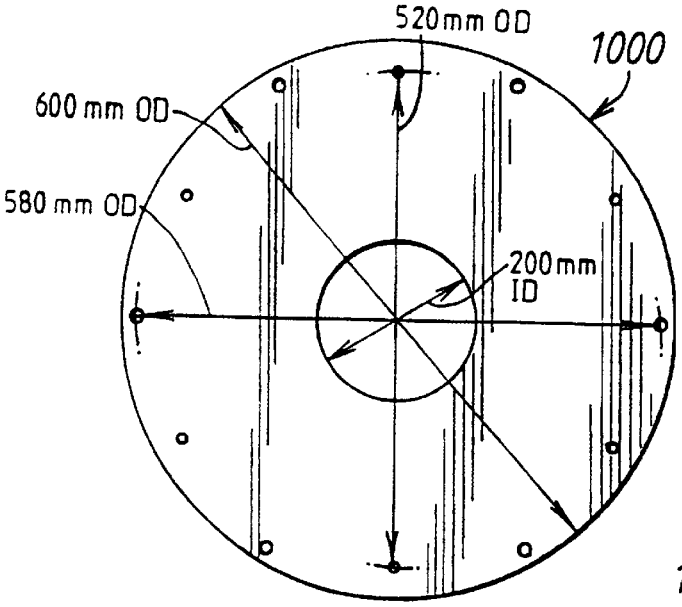
FIG. 10 illustrates a second embodiment of an annular Weir plate.
Figure 10A:
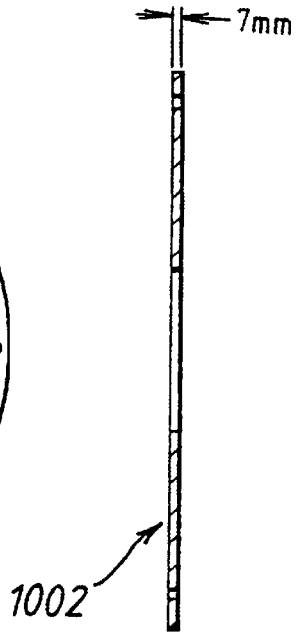

Referring to FIG. 10, there is shown plan 1000 and cross-sectional 1002 views of a second embodiment of the Weir plate 604 in which all dimensions are identical to those shown in FIG. 9. The Weir plate depicted in FIG. 10 is made from LEXIN 5309 (a high temperature metal).

Figure 11:
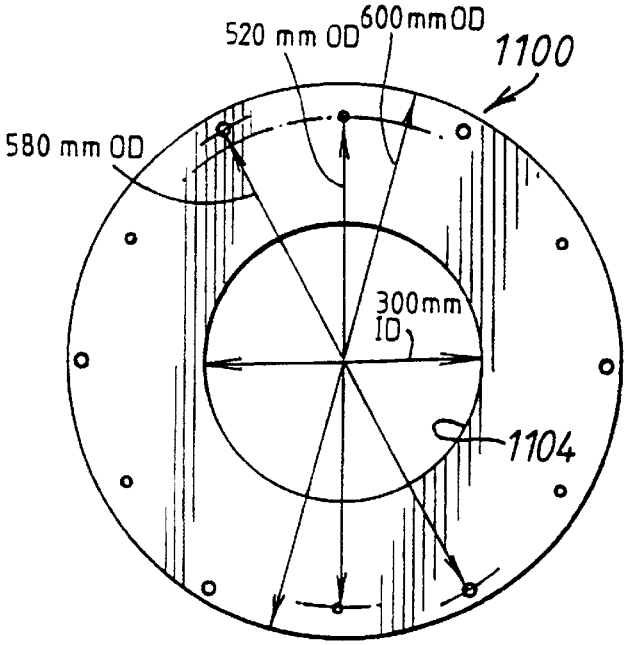
FIG. 11 illustrates a third embodiment of an annular Weir plate.
Figure 11A:
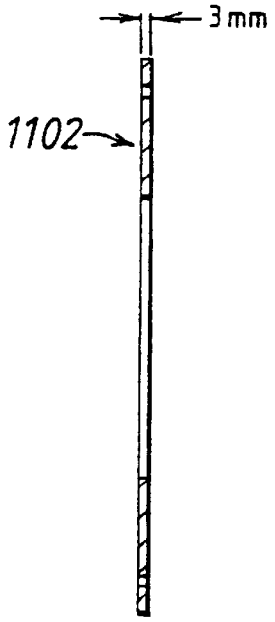

FIG. 11 illustrates a still further embodiment of a 37-18 Nickel Chromium Weir plate 604 in plan 1100 and cross-sectional 1102 views. All dimensions are identical to those depicted in FIG. 9 but for the inner diameter. The inner diameter 1104 is 300 mm . The mass of the Weir plate 604 is 5 kg. The volume of the Weir plate 604 is 0.00063 kg.

Figure 12:
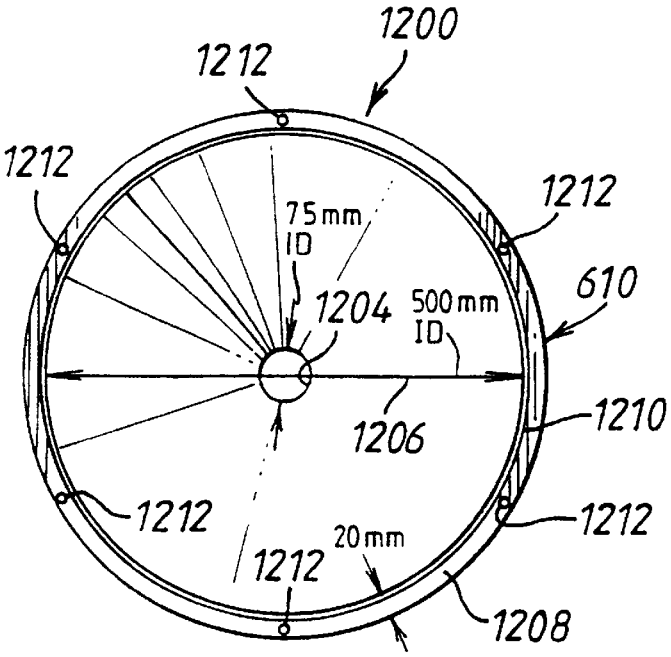
FIG. 12 illustrates an embodiment of a tapered front plate.
Figure 12A:
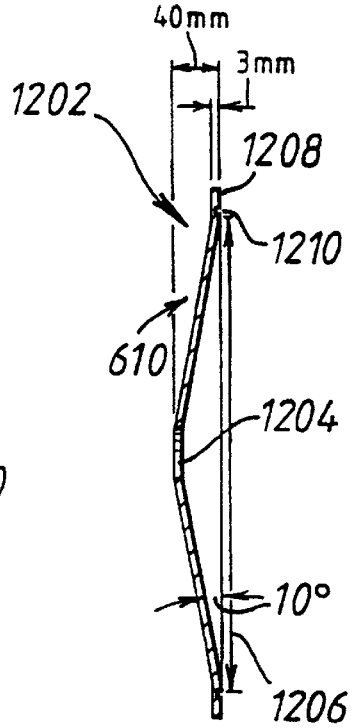

FIG. 12 illustrates plan 1200 and cross-sectional 1202 views of the tapered front plate 610. The tapered front plate 610 comprises an centrally disposed aperture 1204 having a diameter of 75 mm. The diameter 1306 of the front plate is 500 mm. The tapered front plate 610 bears a flanged flat edge 1208 of 20 mm and a 2 mm×2 mm circular grove 1210 for receiving a corresponding edge of the air distributor 608. The flange 1208 bears six bolt holes 1212 centred on 520 mm. The taper of the front plate 610 is substantially 10°. The thickness of the plate is 3 mm. The depth of the front plate is substantially 40 mm. The mass of the front plate is 5.3 kg. The volume of the front plate is 0.000674 $m^3$.

Figure 13:
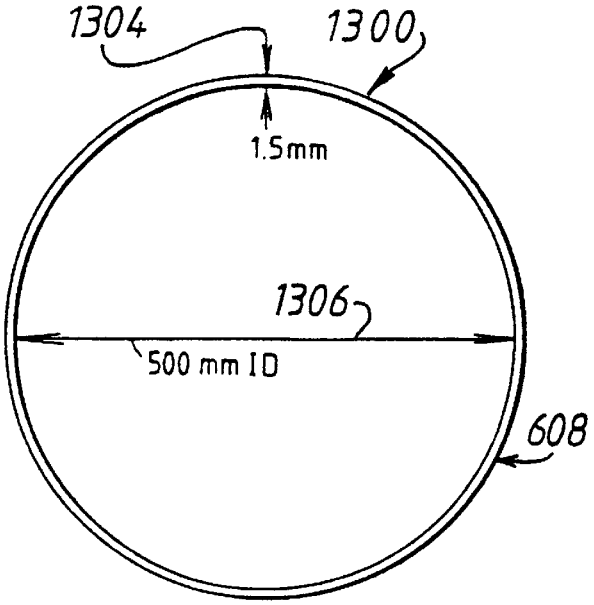
FIG. 13 illustrates an air distributor of the rotatable fluidised bed incinerator.
Figure 13A:
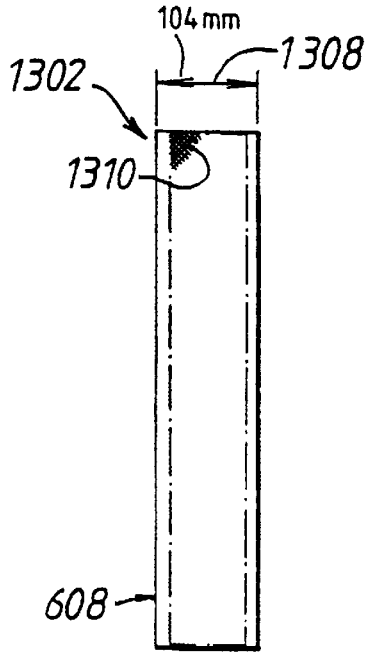

Referring to FIG. 13, there is shown plan 1300 and cross-sectional 1302 views of the air distributor 608. The air distributor has a thickness 1304 of 1.5 mm, an inner diameter 1306 of 500 mm and a depth 1308 of 104 mm. It can be seen that the aspect ratio, that is the ratio of the depth 1308 of the air distributor 608 to the diameter 1306 of the distributor 608 is less than or equal to one. The air distributor 608 is made from a stainless steel sintered mesh and bears a plurality of holes 1310 having diameters of less than 0.75 mm. The mass of the air distributor 608 is 1.9 kg. The volume of the air distributor 608 is 0.000246 $m^3$. The whole pattern is of a 3% free area distribution.

Figure 14:
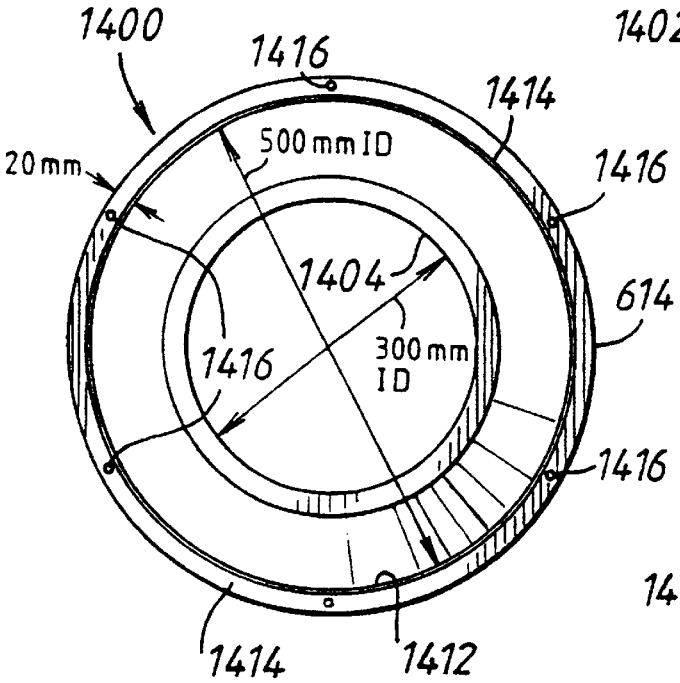
FIG. 14 illustrates a first embodiment of a tapered end plate.
Figure 14A:
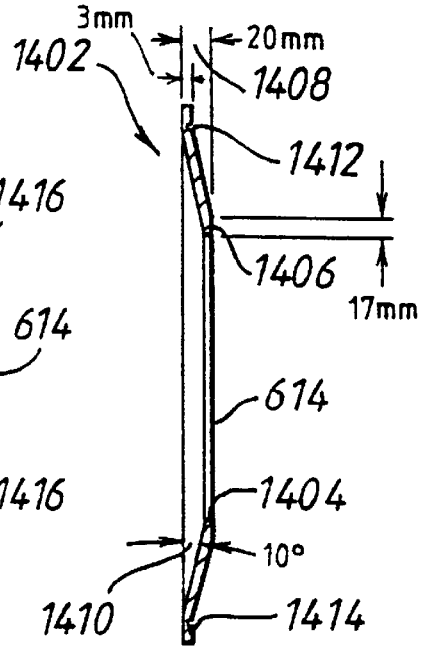

There is shown in FIG. 14 plan 1400 and cross-sectional 1402 views of a first embodiment of a tapered end of the tapered end plate 614. The tapered end plate 614 is made from 3 mm thick 37-18 nickel chromium and bears a centrally disposed 300 mm diameter aperture 1404. The tapered end plate 614 has a 17 mm flanged flat edge 1406. The plate has a depth 1408 of 20 mm and is dished at an angle 1410 of 10°. The tapered end plate 614 bears a 2 mm×2 mm grove 1412 having an inner diameter of 500 mm for receiving a corresponding edge of the air distributor 608. A 20 mm flange 1414 having a diameter of 540 mm is provided. The flange 1414 bears six bolt holes 1416 at a diameter of 520 mm. The tapered end plate 614 has a volume of 0.000475 $m^3$ and a mass of 3.7 kg.

Figure 15:
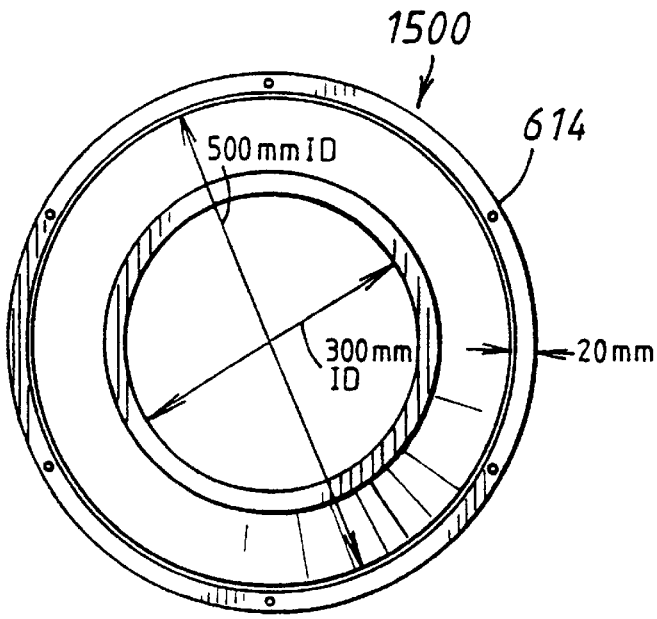
FIG. 15 illustrates a second embodiment of a tapered front plate.
Figure 15A:
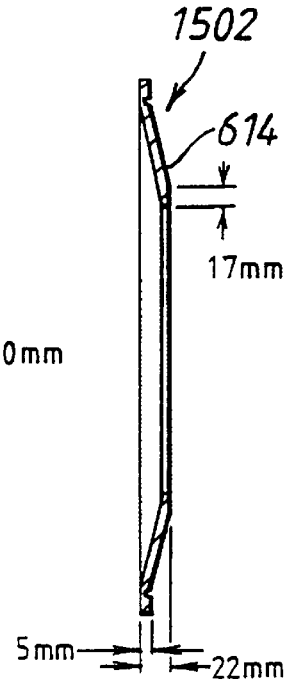

There is shown in FIG. 15 plan 1500 and cross-sectional 1502 elevations of a second embodiment of the tapered end plate 614. All dimensions of the second embodiment are identical to those of the first embodiment depicted in FIG. 15. However, the second embodiment of the tapered end plates 614 was manufactured from LEXIN 5309 (a high temperature metal).

Figure 16A:
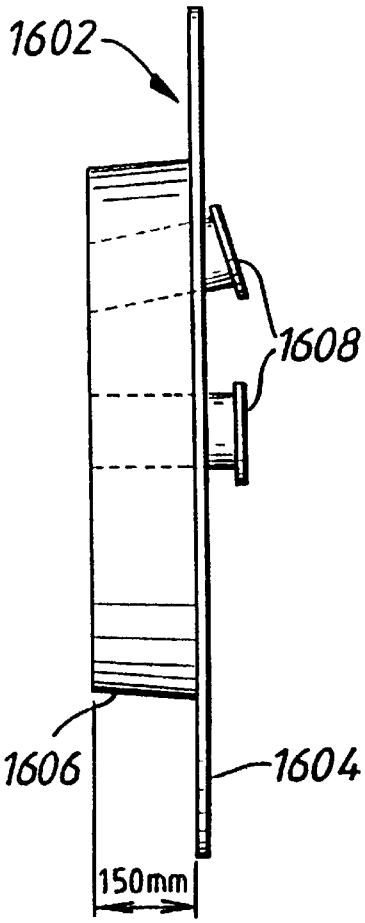
FIG. 16 illustrates a viewing flange.
Figure 16:
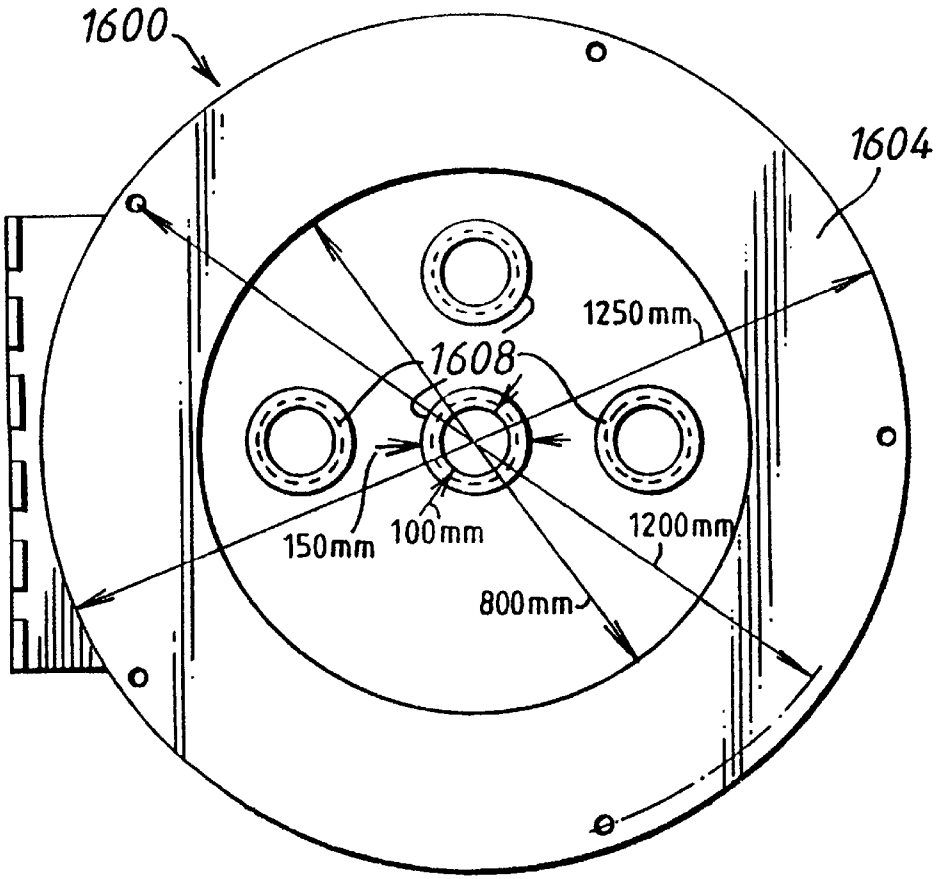

Optionally, a viewing flange, as shown in plan 1600 and sectional 1602 elevations in FIG. 16, may be provided. The flange is made from steel and a suitable refractory material. The viewing flange has a steel outer face 1604 of 1250 mm diameter. A refractory portion 1606 is provided which has a thickness of 150 mm. The refractory portion bears four 10.16 mm ports 1608 having outer diameters of 150 mm and inner diameters of 100 mm. Preferably, the flange is hingedly mounted to the chamber 508. The ports 1608 allow observations of the operation of the fluidised bed and access for measurement instrumentation.

It will be appreciated that the embodiments described with reference to FIGS. 5 to 16 can be operated at an angle to the horizontal as shown in FIGS. 4*a* and 4*b*.

The tapered front and end plates for the progressively varying cross-section of the rotatable fluidised bed provide or allows there to be provided a substantially constant gas flow rate across the whole depth of the fluidised beds. As a consequence of the substantially constant gas flow rate, the depth of the fluidised bed can be substantially increased as compared to prior art fluidised beds. Typically, with the present invention, fluidised bed depths of up to 200 mm can be achieved.

Although the above embodiments have been described with reference to incineration of sewage, the present invention is not limited thereto. It will be appreciated that any suitably sized combustible material can be incinerated using the present invention.

What is claimed is:

1. A rotatable fluidised bed incinerator comprising a rotatable combustion chamber, means for rotating the combustion chamber, means for introducing combustible material into the chamber, means for introducing a gas into the chamber radially-inwardly towards the axis of rotation of said chamber to create a fluidised bed within the chamber with a flow area comprising a curved surface of a cylinder of any given radius, characterised in that the flow area of the chamber remains substantially constant with decreasing flow area radius or the flow area of the chamber increases with decreasing flow area radius.

2. A rotatable fluidised bed incinerator comprising a rotatable combustion chamber, means for rotating the combustion chamber, means for introducing combustible material into the chamber, means for introducing a gas into the chamber radially-inwardly towards the axis of rotation of said chamber to create a fluidised bed within the chamber with a flow area comprising a curved surface of a cylinder of any given radius, characterized in that the flow area of the chamber remains substantially constant with decreasing flow area radius or the flow area of the chamber increases with decreasing flow area radius, wherein the combustion chamber comprises front and end walls which taper towards each other in a radially outward direction.

3. An incinerator according to claim 2, wherein the incinerator has a short aspect ratio of less than or equal to one.

4. An incinerator as claimed in claim 2, in which the incinerator is provided with a cylindrical chamber having substantially parallel walls.

5. An incinerator according to claim 2, which also comprises a de-watering unit.

6. An incinerator according to claim 2, wherein the fluidised bed comprises particles of an average diameter of 0.1–3 mm.

7. An incinerator according to claim 2, wherein the means for rotating the combustion chamber comprises means for varying the speed of rotation of the combustion chamber.

8. An incinerator according to claim 2, wherein the chamber is arranged to rotate about an axis which is inclined relative to the horizontal.

9. A rotatable fluidised bed incinerator comprising a rotatable combustion chamber, means for rotating the combustion chamber, means for introducing combustible material into the chamber, means for dewatering the combustible material to a solid concentration of from 20 to 50%, preferably 28 to 35%, before it is introduced into the combustion chamber, means for introducing a gas into the chamber radially-inwardly towards the axis of rotation of said chamber to create a fluidised bed within the chamber with the flow area comprising a curved surface of a cylinder of any given radius, characterized in that the flow area of the chamber remains substantially constant with decreasing flow area radius or the flow area of the chamber increases with decreasing flow area radius and the combustion chamber comprises front and end walls which taper towards each other in a radially outward direction.

10. An incinerator as claimed in claim 1, further comprising means for imparting a tumbling action to the combustible material within the combustion chamber.

11. An incinerator according to claim 3, wherein the combustion chamber comprises front and end walls which taper towards each other in a radially outward direction.

12. An incinerator as claimed in claim 3, in with the incinerator is provided which a cylindrical chamber having substantially parallel walls.

13. An incinerator as claimed in claim 2, in with the incinerator is provided which a cylindrical chamber having substantially parallel walls.

14. An incinerator according to claim 3, which also comprises of a de-watering unit.

15. An incinerator according to claim 2, which also comprises of a de-watering unit.

16. An incinerator according to claim 4, which also comprises a de-watering unit.

17. An incinerator according to claim 3, wherein the fluidised bed comprises particles of an average diameter of 0.1–3 mm.

18. An incinerator according to claim 2, wherein the fluidised bed comprises particles of an average diameter of 0.1–3 mm.

19. An incinerator according to claim 4, wherein the fluidised bed comprises particles of an average diameter of 0.1–3 mm.

20. An incinerator according to claim 5, wherein the fluidised bed comprises particles of an average diameter of 0.1–3 mm.

* * * * *